United States Patent [19]

Ganz

[11] 4,163,352

[45] Aug. 7, 1979

[54] BOTTLE PACKAGING MACHINE

[75] Inventor: Robert H. Ganz, Saddle River, N.J.

[73] Assignee: Federal Paper Board Company, Inc., Montvale, N.J.

[21] Appl. No.: 894,502

[22] Filed: Apr. 7, 1978

Related U.S. Application Data

[62] Division of Ser. No. 805,855, Jun. 13, 1977, Pat. No. 4,100,715.

[51] Int. Cl.[2] ..... B65B 61/00

[52] U.S. Cl. ..... 53/393

[58] Field of Search ..... 53/393, 48; 93/36 R, 93/49 R, 84 R

[56] References Cited

U.S. PATENT DOCUMENTS 3,186,136 6/1965 Ganz ..... 53/48 X

*Primary Examiner*—Travis S. McGehee

*Attorney, Agent, or Firm*—Guy A. Greenawalt

[57] ABSTRACT

A machine is disclosed for packaging a group of beverage bottles, or similar articles, in a wrap-around type blank of foldable sheet material which machine is characterized by a traveling conveyor onto which successive cut and scored blanks are fed and advanced through successive work areas where there are mechanisms for partially folding handle and wall forming panels into which the blanks are divided, which mechanisms include continuously traveling pairs of forming die members which are arranged to move into mating relation against opposite faces of successive blanks so as to fold certain of the panels while the blanks are advanced to a transporting conveyor which carries the partially folded blanks to an assembly area and deposits them on a group of bottles advancing on a bottle conveyor traveling beneath the blank transporting conveyor, mechanism at the assembly area which is operative to seat the partially folded blanks in telescoping relation on the bottles with the handle panels depending between pairs of the bottles and mechanism to hold the blanks in properly seated position on the groups of bottles while they are advanced through a further work area where mechanism is provided for folding end panels of the blanks into wall forming position beneath the bottles and fastening the same together.

5 Claims, 27 Drawing Figures

163
63'
62
234
18
F.
230
E.
160
D.
18
67
9
100
C.
86
B.
9
60
A.
74
73
65
64
63

63'
62
236
237
234'
233
260
62'
F.
E.
230
13
D.
200
C.
13
100
B.
87
86
A.
76
162
63

Sta. D.
Sta. E.
160
162
164
164'
165
166
167
168
170
172
173
174
175
176
176'
177
177'
178
178'
180
180'
182
182'
183
183'
184
185
200
203
204
207
208
215
218
230
232
233
235
236
240
242
243
244
245
256
257
258
14
15
16

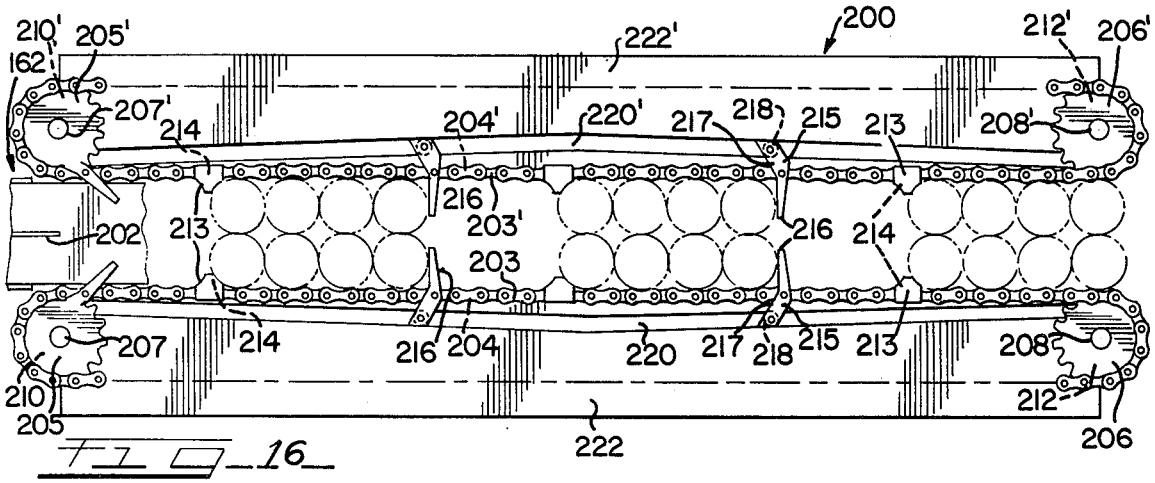
FIG. 16
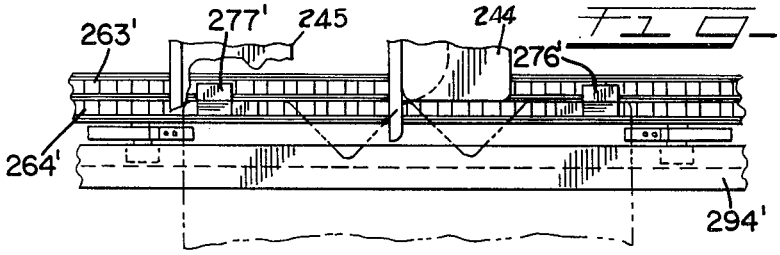
FIG. 19
FIG. 18
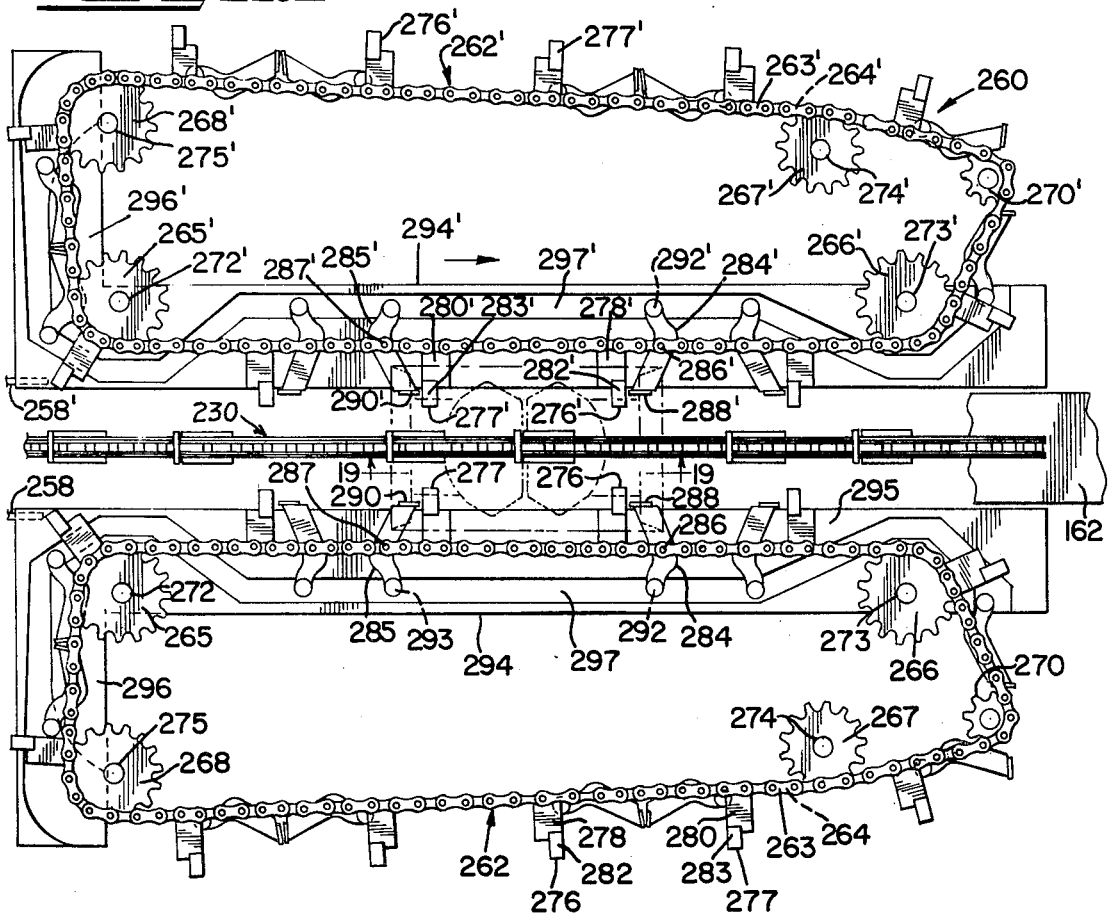

BOTTLE PACKAGING MACHINE

This is a division, of application Ser. No. 805,855, filed June 13, 1977, now Pat. No. 4,100,715.

BACKGROUND OF THE INVENTION

This invention relates to the packaging of articles, for example, bottled products such as bottled beverages, or the like, and is more particularly concerned with improvements in machinery for encasing an assembly of bottles arranged in row forming relation in a wrap-around type carton blank of paperboard or similar foldable carton or package forming material.

In the packaging industry, several different types of packages have been employed in the marketing of bottled products, and widely accepted by users, particularly, for such products as bottled beverages, which are conveniently arranged in double row relation and enclosed in a carton or wrapper. One such package which is in the form of an open top cellular basket lends itself most readily to multiple trip use and has been used extensively for marketing beverages in returnable bottles. However, this type package has certain disadvantages. It requires the use of stock material of substantial weight or thickness and initial gluing and folding both of which increase the cost. In addition, it is generally loaded by dropping the bottles in the cells from the top which presents an undesirable bottle breaking hazard. There are also certain disadvantages in its production and subsequent handling.

Upon the introduction of the non-returnable, diposable beverage bottles, the use of the more economical single trip wrap-around type blank which had been developed primarily for packaging canned products became popular and has had extensive use for packaging the bottled products. However, the package formed with the wrap-around type blank commonly provided has not been found satisfactory for marketing the returnable bottle products because opening the package for removal of the bottles destroys its carrying capability. Responding to pressure from ecological minded groups and others, the use of non-returnable bottles has decreased and, in some cases, they have been banned by government regulation.

This has led to renewed efforts to develop wrap-around type packages having multiple trip capabilities so as to be more acceptable for packaging an array of bottled products in returnable bottles. One such package, employing a newly developed single paperboard blank, which is designed to be wrapped about an assembly of bottles in row arrangement and to be adapted for use in returning empty bottles to the source of purchase, is described in U.S. Pat. No. 3,977,518, granted to Edwin L. Arneson on Aug. 31, 1976.

The development of new packages or packaging improvements in the bottle and can packaging industry most often has required the modification of the machinery heretofore developed for forming the earlier developed packages or the development of new machinery for assembling the bottles into the desired arrangement and encasing them in the carton or carrier. Machines which have been developed heretofore for use in applying the wrap-around type carton blank to groups of cans or bottles have included features described in a number of patents granted to me including: U.S. Pat. No. 3,083,510, dated Apr. 2, 1963, and U.S. Pat. No. 3,474,590, date Oct. 28, 1969. These machines have been designed to apply a wrap-around blank which does not require any appreciable pre-folding before assembly with the bottles. They have included provisions for drawing panels carrying interengaging locking and latching elements into proper relation for engaging the locking and latching elements and compressing the assembly so as to obtain a package in which the blank is tightly wrapped about the can or bottle assembly and securely held without the use of adhesives. These machines and others of similar type have not been considered readily adaptable to the packaging of bottle assemblies with the new type wrap-around blank referred to, which requires substantial pre-folding before assembly with a group of bottles, since the machines heretofore available have not been designed to take care of the pre-folding requirements of the new blank.

A general object of the present invention is to provide an improved machine for packaging groups of bottles in a wrap-around type blank of paperboard or similar foldable material which enables folding of certain panel elements of the blank prior to assembly of the blank with the bottles and adequate control of the partially folded blank while it is assembled with a group of bottles and secured in tight carton forming arrangement about the bottles.

A more specific object of the invention is to provide a machine for automatically applying, in carton forming relation about an assembly of bottles which are arranged in row relation, a wrap-around type packaging blank of foldable sheet material which is cut and scored so that it may be, in part, pre-folded and thereafter telescoped over a group of bottles, with a top wall and adjoining side walls from which a pair of handle panels are taken, the handle panels being of a size to be folded on transverse hinge lines so as to be disposed between the top portions of the center bottles in depending handle forming and bottle separating position and to leave top openings which are of adequate size for removal of the bottles immediately adjacent the handle without damaging the carton.

Another object of the invention is to provide a machine for applying to a bottle assembly a wrap-around type carton forming blank of paperboard or similar material which has provision for initially pre-forming wall panels in the blank which constitute the top and side wall members of the carton so as to bring a pair of associated handle forming panels into position for insertion between the tops of adjacent pairs of bottles after which the partially folded carton is deposited in telescoping relation onto the bottle assembly.

Still another object of the invention is to provide a bottle wrapping machine which is adapted to partially preform a wrap-around type blank and advance the same for deposit in downwardly telescoping relation onto a group of bottles which are arranged in double row and transversely paired relation so as to position certain pre-folded panels on the blank between adjacent pairs of bottles.

To this end the invention as claimed is embodied in a machine for packaging groups of bottles in a cut and scored blank of foldable paperboard or similar packaging material which machine includes means for continuously feeding the package forming blanks in a path along which there are mechanisms which effect the pre-forming of certain of the panels into which the blank is divided and which deliver the partially preformed blanks for advance to an assembly area for application to a group of bottles on a bottle carrying conveyor.

The invention will be best understood when reference is made to the accompanying detailed description of the preferred embodiment thereof which is set forth therein, by way of example, and shown in the accompanying drawings wherein like reference numerals indicate corresponding parts throughout.

BRIEF DESCRIPTION OF THE DRAWINGS

FIG. 16 is a plan view, taken on the line 16—16 of FIG. 13, showing the bottle grouping and spacing conveyor arrangement;

FIG. 18 is a plan view, taken on the line 18—18 of FIG. 1, to an enlarged scale, and showing mechanism for holding the blanks in seated position on the bottles and for folding in the gusset panels at the forward and trailing ends of each blank and bottle assembly;

FIG. 19 is a cross sectional view taken on the line 19—19 of FIG. 18;

DESCRIPTION OF THE PREFERRED EMBODIMENTS OF THE INVENTION

Figure 1:
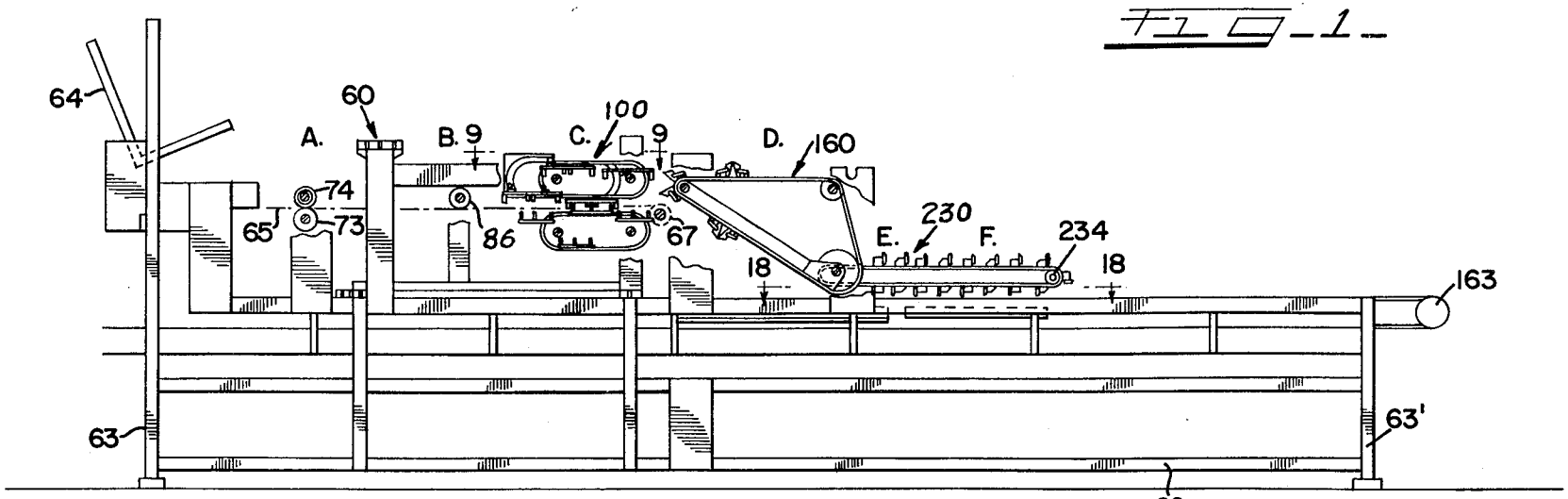
FIG. 1 is a side elevational view, partially schematic and with portions broken away or omitted, of a bottle packaging machine embodying the principal features of the invention.
Figure 2:
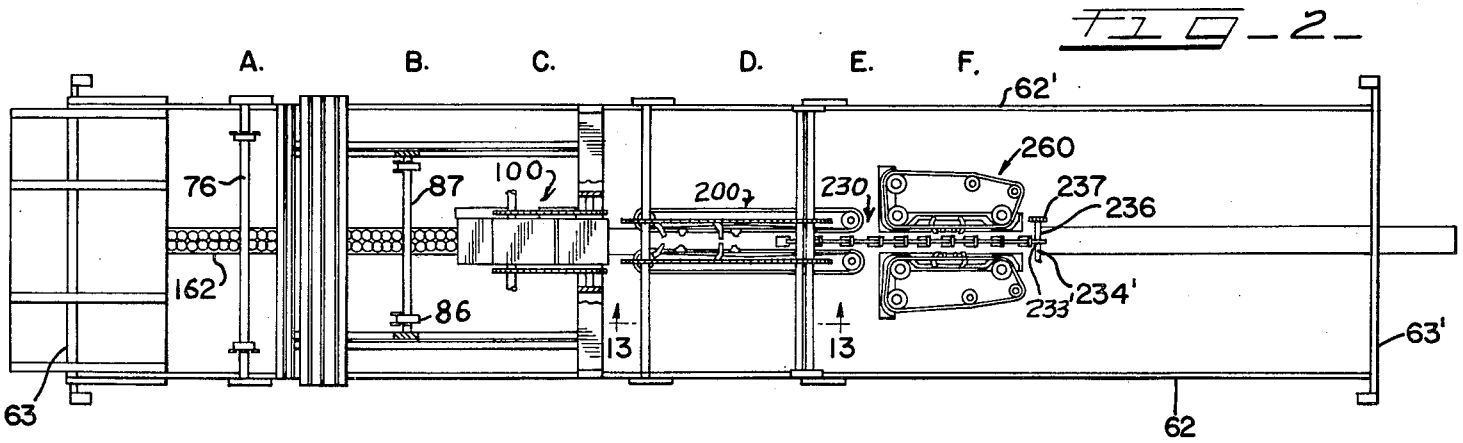
FIG. 2 is a plan view, partially schematic and with portions broken away or omitted, of the machine of FIG. 1.
Figure 20:
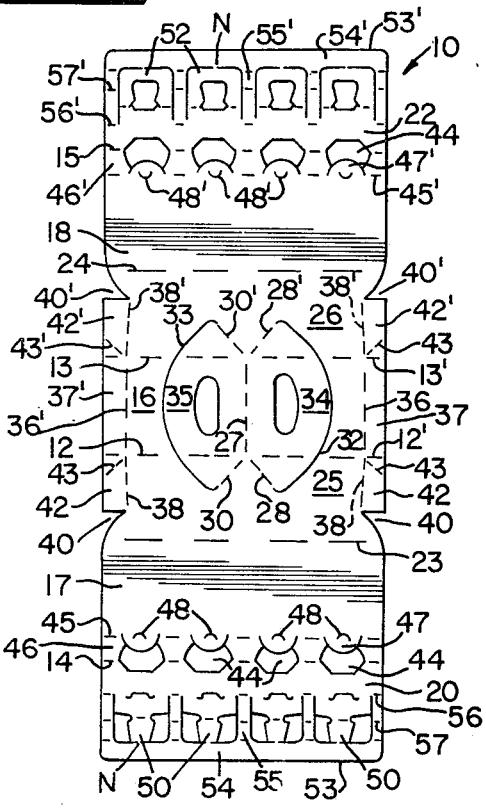
FIG. 20 is a plan view of a cut and scored blank which the machine of FIGS. 1 to 19 is adapted to apply to an assembly of bottles.
Figure 22:
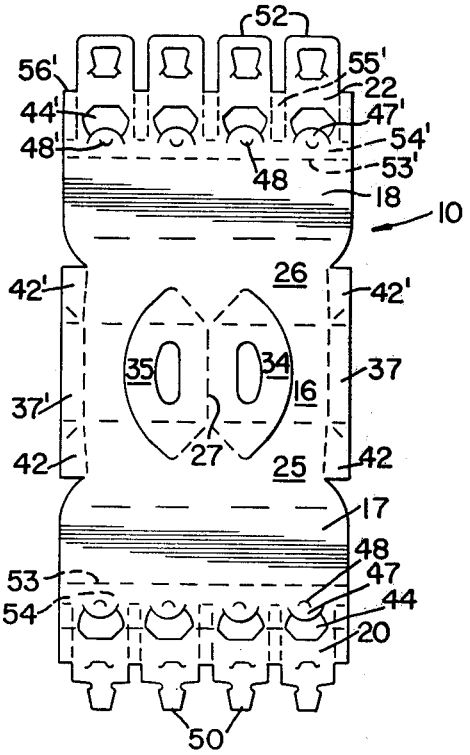
FIG. 22 is a plan view of the blank of FIG. 20 with the heel hole reinforcing panels folded into position on the inside face of the blank.
Figure 21:
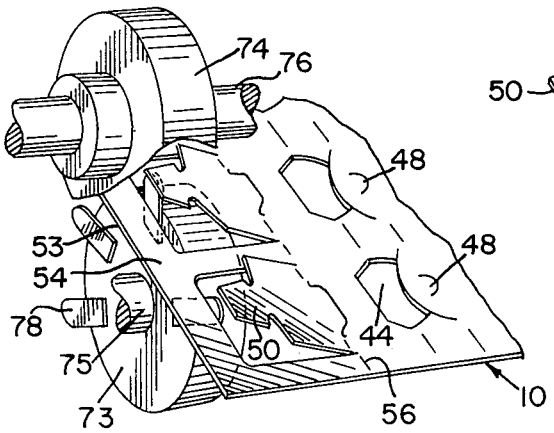
FIG. 21 is a fragmentary perspective view illustrating the breaking of uncut blank portions connecting the outboard edges of the latching and locking elements for the bottom wall panels and bottle heel hole reinforcing panels extending along opposite end margins of the blank.
Figure 21:
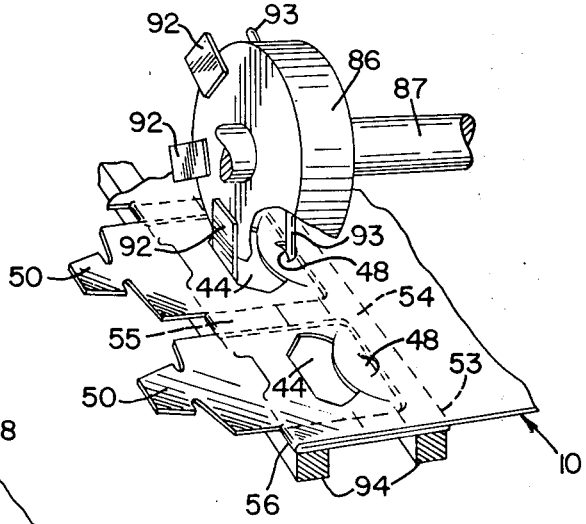
Figure 23:
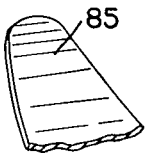
FIG. 23 is a perspective view illustrating the securing of the heel hole reinforcing panels by small tab members located adjacent the heel holes.
Figure 24:
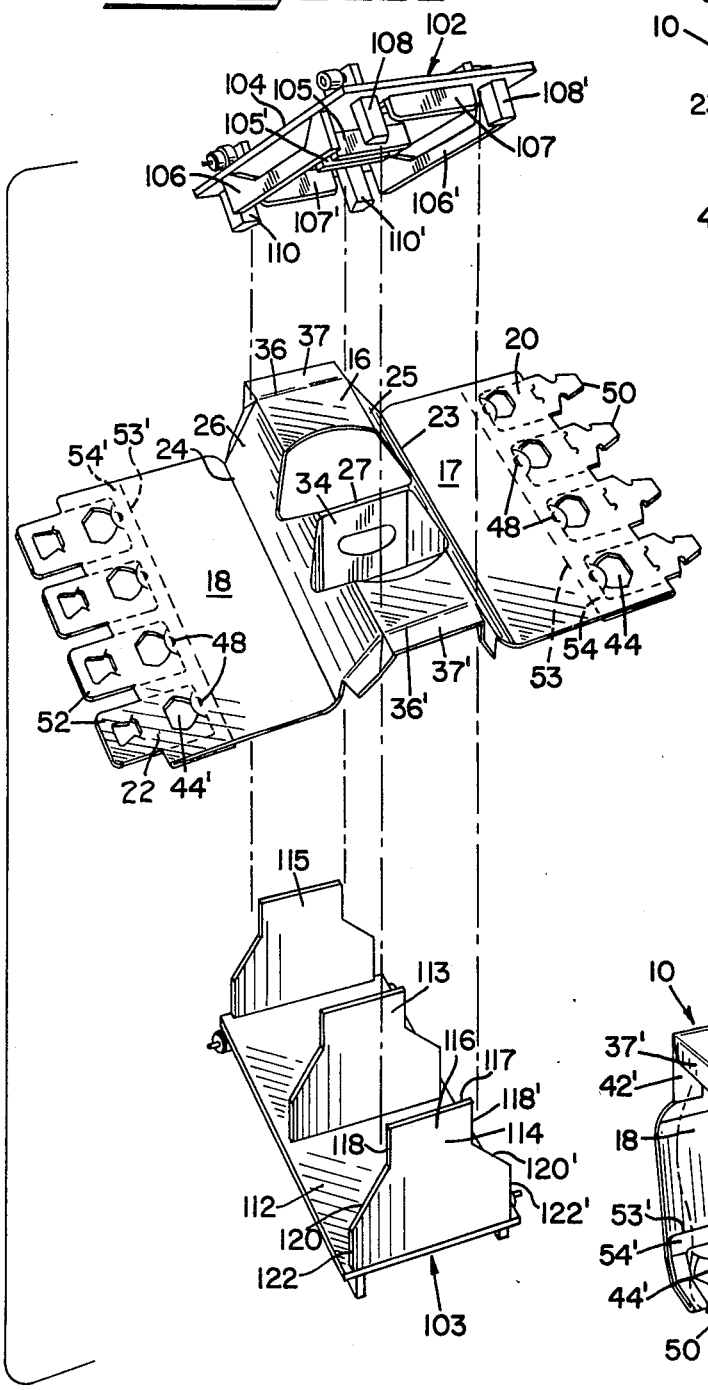
FIG. 24 is an exploded perspective view illustrating the folding of the blank by the pre-forming mechanism preparatory to assembly of the blank with a group of bottles.
Figure 25:
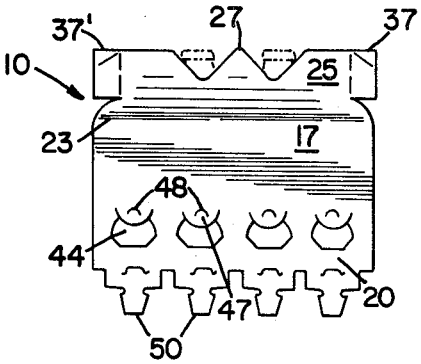
FIG. 25 is a side elevational view showing the pre-formed blank telescoped onto a group of bottles.
Figure 26:
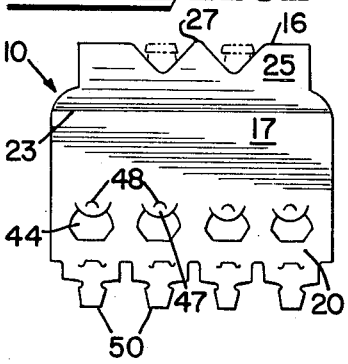
FIG. 26 is a side elevational view showing the blank and bottle assembly with top end wall panels folded into position.
Figure 27:
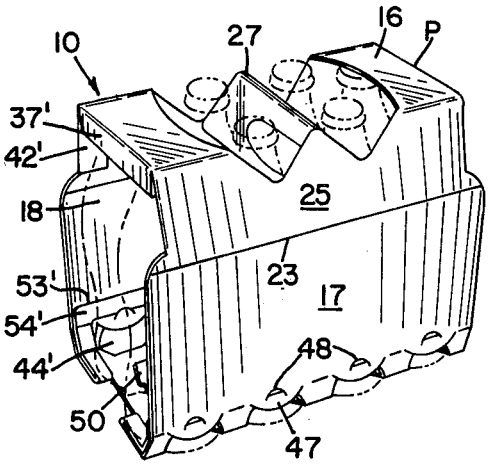
FIG. 27 is a perspective view showing the completed package as produced by the machine of FIGS. 1 to 19.

Referring first to FIG. 20, there is illustrated a cut and scored paperboard blank 10 which is adapted to be fed to the machine of FIGS. 1 and 2 and folded or wrapped about a group of bottles to form the completed package shown in FIG. 27. The machine operates on the blank to effect certain preliminary folding or pre-forming of the panels, into which the blank is divided, so as to bring the blank into the condition illustrated in FIG. 24 after which it is assembled with a group of bottles, as shown in FIG. 25, and the folding is then completed with the bottom wall forming panels latched together so as to enclose or encase the bottles in a tubular wrapper or carton having an adequate handle formation for carrying the package and having provision for removing and replacing the bottles without destroying its carrier-package forming capabilities.

The elongate rectangular blank 10 is divided by longitudinally spaced, hinge forming score lines 12, 13 and 14, 15 into a top wall forming panel 16, adjoining side wall forming panels 17, 18 and bottom wall forming or bottom closure panels 20, 22. The side wall forming panels 17 and 18 are subdivided by transverse score lines 23, 24, which are longitudinally spaced outboard of the score lines 12, 13. These score lines 23, 24 set off from the main body of the side wall panels 17, 18 top wall portions 25, 26 which slant outwardly and downwardly of the top wall panel 16 in the completed package. The top wall panel 16 is divided by a center longitudinally extending score line 27 which extends between the score lines 12, 13 and terminates at its opposite ends at the intersection of pairs of score lines 28, 30 and 28', 30' which diverge in the direction of opposite ends of the blank. The diverging lines of each pair of the score lines 28, 30 and 28', 30' extend in the top side wall portions 25, 26 to the ends of cutting lines 32, 33 which are spaced on opposite sides of the score line 27 and bowed outwardly in the direction of the opposite side edges of the blank. The cutting lines 32, 33 define the free edges of a pair of handle panels 34, 35 which are adapted to hinge, about the center score line 27 and the pairs of diverging score lines 28, 30, and 28', 30' at opposite ends thereof, downwardly into the carrier when it is completely formed. This portion of the blank and carrier is formed according to the description in U.S. Pat. No. 3,977,518 granted Aug. 31, 1976, so as to provide a means for gripping and carrying the package and at the same time providing top exit openings for the two pairs of bottles which are adjacent the handle formation. Score lines 36, 36' extend longitudinally of the blank between score lines 12 and 13 at opposite ends of the top wall panel 16 and divide the same so as to provide relatively narrow rectangular panels 37, 37' which are adapted to be hinged downwardly and which may serve as identification panels and also as retainers for the tops of the endmost bottles. The score lines 36, 36' are each extended at the opposite ends thereof, in an identical manner, on lines 38, 38' a substantial distance into the top side wall portions 25, 26 and inclined slightly toward the longitudinal center of the blank. These score lines 38, 38' terminate at edge notches 40, 40' so as to form small web panels 42, 42' which are divided from the end panels 37, 37' by extensions 12', 13' of the transverse score lines 12, 13 and which are scored diagonally on the lines 43, 43' enabling the end panels 37, 37' to be folded inwardly and held in panel retaining position (FIG. 27). The main body portions of the side wall panels 17 and 18 are separated from the bottom wall panels 20 and 22 by the bottom hinge forming score lines 14 and 15 which are interrupted by a series of bottle retaining heel holes 44, 44' spaced according to the spacing of the bottles in the rows. Transverse score lines 45, 45' are spaced a short distance from the hinge forming score lines 14 and 15 in the direction of the center of the blank and with the hinge lines define relatively narrow inclined panels 46, 46' through which portions of the bottle heels project in the holes 44, 44'. At each of the holes 44, 44' the blank material is cut on small half circle lines to provide semi-circular panels or tab members 47, 47' which extend into the holes 44, 44' and in turn smaller half circle lines which bow in the opposite direction are cut to provide small tab members 48, 48' in each of the members 47, 47' for a purpose which will be hereinafter referred to. The end marginal portions of the blank which provide the bottom wall panels 20, 22 are cut and scored, in the manner shown in U.S. Pat. No. 3,797,729, granted Mar. 19, 1974, to provide male latching and locking elements 50, in the panel 20, and cooperating apertured female elements 52, in the panel 22. In addition, the end margins of these panels are cut to provide heel hole reinforcing panels 53 and 53' which comprise relatively narrow transverse strap members 54, 54' and a plurality of transversely spaced struts 55, 55' which are scored transversely on the lines 56, 56' and 57, 57', so that the panels 53, 53' may be initially folded into engagement with the inside face of the blank on the hinge forming score lines 56, 56' and subsequently folded along with the panels 20, 22 on the hinge forming score lines 57, 57' when the panels 20, 22 are folded on the corner forming hinge lines 14 and 15. The folding sequence of the various panels into which the blank 10 is divided is illustrated in FIGS. 20 to 27 and will be hereinafter referred to in connection with the description of the mechanisms which constitute the machine of FIGS. 1 and 2 and the operation of the various mechanisms which fold the successive blanks 10 about gropus or assemblies of bottles so as to produce finished packages P as shown in FIG. 27.

The machine 60 as shown in FIGS. 1 and 2 comprises apparatus or mechanism supported between laterally spaced upright side frames 62 and 62' which extend between longitudinally spaced end frames 63 and 63', with suitable cross bracing connecting the side frames 62, 62' at various points along the frames and supporting the various mechanism which operate on the blanks 10. The blanks 10 are fed from a hopper 64 at the entrance end of the machine and deposited, printed side up, for advance on a traveling conveyor 65. The blanks may be fed from the hopper 64 and deposited on the conveyor 65 by a feed mechanism of the type shown and described in U.S. Pat. No. 3,202,421 granted Aug. 24, 1965. The conveyor 65 comprises laterally spaced chains 66, 66' which are supported on pairs of end sprockets axially spaced on cross shafts, only one pair of which is indicated at 67. The chains 66, 66' have pusher forming lugs 68, 68' which are properly spaced on the chains so as to engage the trailing edges of successive blanks 10. Suitable guide rail assemblies indicated at 70, 70' (FIG. 4) are provided for holding the top run of the chains in a level path while hold down rails 72, 72' retain the blanks in properly seated relation thereon. Lateral guide members (not shown) center the blanks on the conveyor 65.

Figure 4:
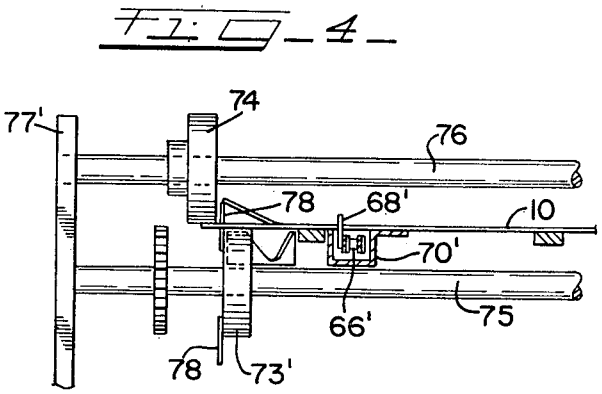
FIG. 4 is a fragmentary cross sectional view taken on the line 4—4 of FIG. 3.
Figure 5:
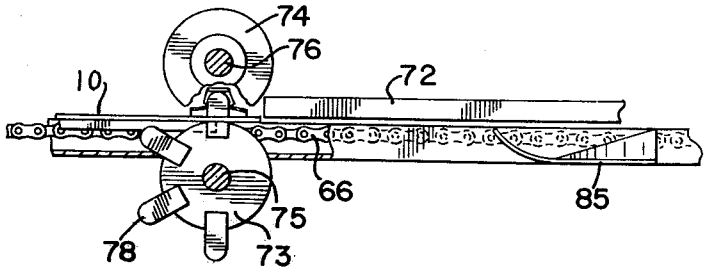
FIG. 5 is a fragmentary longitudinal sectional view taken on the line 5—5 of FIG. 3, with portions broken away.
Figure 3:
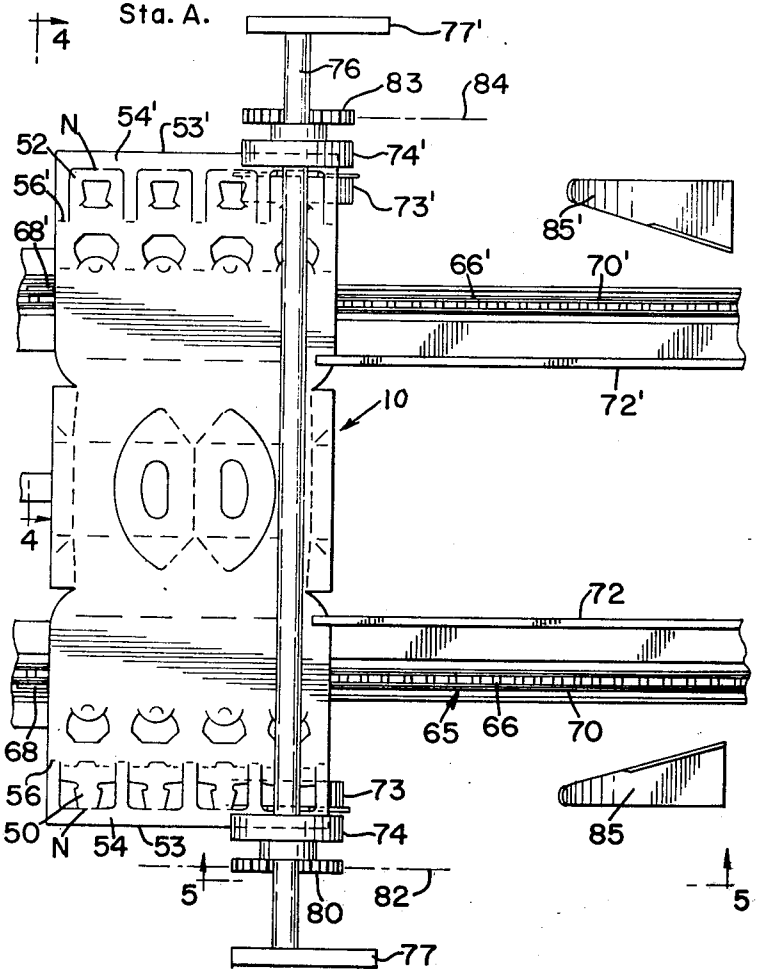
FIG. 3 is a fragmentary plan view showing a blank positioned with its long dimension extending transversely on a blank feeding conveyor and advanced to a first work station where marginal panels extending along opposite sides of the conveyor are released for folding by passing between pairs of narrow rollers, the bottom ones of which have means for breaking uncut portions of the blank so as to free these panels for folding relative to the remainder of the blank.
Figure 6:
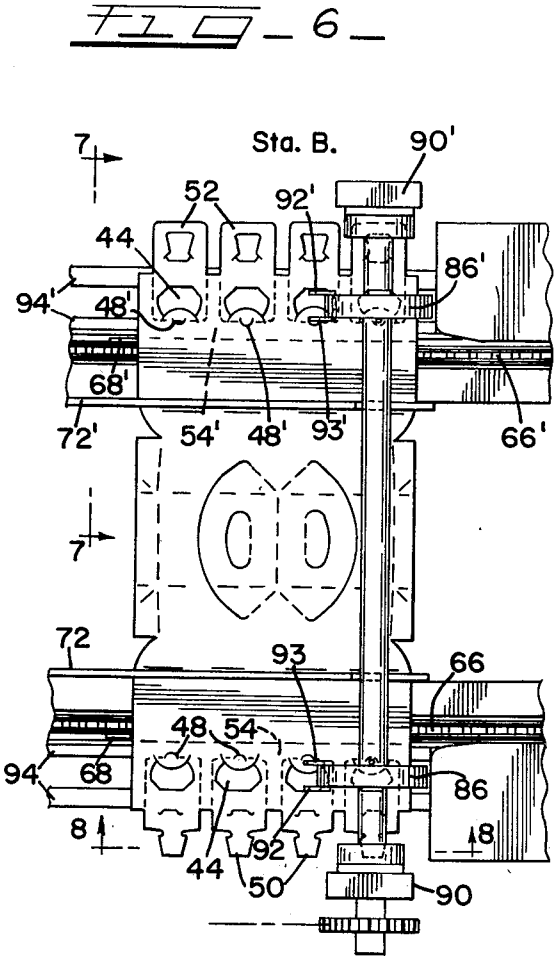
FIG. 6 is a fragmentary plan view showing a blank advanced to a second work station where the blank passes beneath rollers having means for forcing small tab members into position for locking in place the marginal panels which have been released at the first work station and plowed into engagement with the underside of the blank.

The blanks 10 are fed onto the conveyor 65 with the longest dimension crosswise, that is, with the endmost blank panels 53, 53' disposed along opposite sides of the path of the conveyor (FIG. 3). Each successive blank is advanced to the first work area or work station, indicated at A of FIGS. 1 to 3 where end marginal portions of the blank are advanced over "nick" breaking rollers 73, 73' and beneath hold down rollers 74, 74' which operate to break the uncut blank portions N, which are commonly referred to as "nicks" and which connect the end panel strap portions 54, 54' and the locking and latching elements 50 and 52. The rollers 73, 73' (FIGS. 3, 4, and 5) are carried on a lower cross shaft 75 while the rollers 74, 74' are carried on an upper cross shaft 76. The shafts 75 and 76 are journaled in parallel relation in upstanding frame plates 77 and 77'. The hold down rollers 74, 74' are axially spaced on the shaft 76 so as to engage the uppermost face of the strip portions 54, 54' of the panels 53, 53'. The rollers 73, 73' are axially spaced on the shaft 75 as shown in FIG. 3 and each of these rollers carries a plurality of radially positioned finger plates 78 which are spaced circumferentially of the rollers according to the spacing of the locking and latching elements on the blank and the spacing of the blanks on the lug chains so as to strike each of the locking and latching elements near the outermost edge and break the small "nick" N which holds the locking and latching elements 50, 52 in the plane of the body of the blank, as shown in FIG. 4. The breaker fingers 78 raise the locking and latching elements out of the plane of the blank which breaks the connecting "nicks" and frees the heel hole reinforcing panels 53, 53' for hinging or folding movement about the hinge lines 56, 56'. The lowermost shaft 75 carries a sprocket 80 which is driven at the proper speed relative to the advance of the blanks on the conveyor 65 by chain 82 running to a part of a suitable drive arrangement for the various moving parts of the machine. At the opposite end of the shaft 75 a sprocket 83 is connected by chain 84 to a drive mechanism in advance of station A. As the blanks advance beyond station A, the heel hole reinforcing panels 53, 53' are turned down and in for engagement with the bottommost face of each blank by cam rails or plows indicated at 85, 85' (FIGS. 3 and 5) which are in the form of plates extending in the area between station A and the next succeeding work station, the latter being indicated at B in FIGS. 1, 2 and 6. The plows 85, 85' are positioned or located and shaped to swing the panels 53, 53' about the hinge lines 56, 56' into face engagement with the blank underside and thereby position the outboard edges of strip portions 54, 54' in overlying relation to the holding tabs 48, 48' in the blank.

Figure 8:
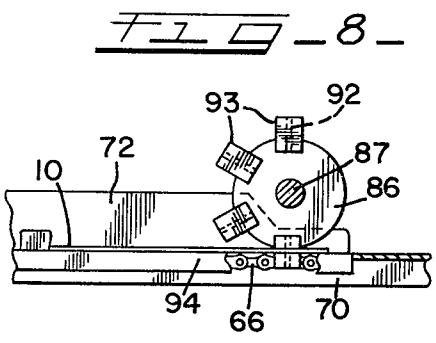
FIG. 8 is a fragmentary longitudinal sectional view taken on the line 8—8 of FIG. 6.
Figure 7:
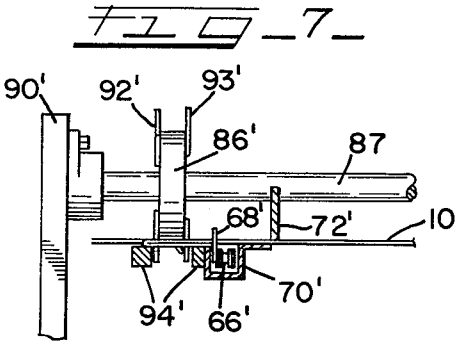
FIG. 7 is a fragmentary cross sectional view taken on the line 7—7 of FIG. 6.

The end marginal portions of the blanks advance beneath rollers 86, 86' (FIGS. 6 to 8) at station B which are supported on a cross shaft 87. The shaft 87 carries a sprocket 88 at one end with a chain drive connection to a part of the lower drive mechanism which is synchronized with the drive for the shaft 75 at station A. The shaft 87 is journaled in upstanding support members 90, 90' forming part of the machine frame. The rollers 86, 86' are in the form of discs, the peripheral edge of which is relatively narrow. A series of peripherally spaced plate fingers 92, 92' extend radially of the outboard faces of the rollers 86, 86' which are of a size to project into the heel holes 44, 44' and engage with the edges defining the outboard sides of the holes 44, 44'. A series of peripherally spaced pin or punch members 93, 93' are mounted in radially extending relation on the opposite or inboard faces of the rollers 86, 86'. The peripheral spacing of the fingers 92, 92' and pins 93, 93' corresponds to the spacing of the heel holes and the holding tabs 48, 48' while the distance between the fingers 92, 92' and the associated pins or punches 93, 93' is such that the punches 93, 93' will engage and depress the holding tabs 48, 48' when the rollers 86, 86' are axially spaced on the shaft 87 so as to insert the fingers 92, 92' in the heel holes and adjacent the outboard edges of the holes. A pair of transversely spaced bottom rails 94, 94' support the blank on opposite sides of the path of the heel holes enabling the holding tabs 48, 48' to be depressed by the punches 93, 93' so as to spring back into overlying engagement with the strip portions 54, 54' of the reinforcing panels 53, 53' and thereby secure the latter in proper heel hole reinforcing position.

As the blanks are advanced beyond the station B on the conveyor 65 the central panel structures are partially formed or pre-formed by the forming mechanism 100 at the station C. The forming or pre-forming mechanism 100 comprises pairs of cooperating male and female forming die members 102 and 103 which are supported for travel in upper and lower paths relative to the path of the blanks 10 which is in a horizontal plane extending transversely of the machine. The uppermost female die members 102 (FIGS. 9, 10, 11 and 24) each comprise a rectangular base plate 104 on one face of which a pair of cross plates 105, 105' are mounted in parallel planes extending normal to the plane of the base plate 104 and transversely thereof. The plates 105, 105' are spaced in the direction of travel and are dimensioned to engage the handle panels 34, 35 of the blank 10 on opposite sides of the fold line 27 when the female forming die 103 and a cooperating male forming die 102 are moved into mating relation, with a blank between them, so as to fold the handle panels 34 and 35 downwardly about the fold line 27, as illustrated in FIG. 24. Elongate plates 106, 106' extend along opposite side edges of the base plate 104 which are positioned to engage the topmost side wall forming panel portions 25, 26 inside the fold lines 23, 24. Small end plates 107, 107' at the leading and trailing ends of the die 103 are dimensioned and spaced to engage the end wall panels 37, 37' and fold the same downwardly about the fold lines 36, 36'. Small, depending, laterally spaced pairs of post members 108, 108' at the leading end of the base plate 104, and 110, 110', at the trailing end of the same, are positioned to engage the web panels 42, 42' at opposite ends of the side wall panels 25, 26 and fold the same downwardly and inwardly about the fold lines 38, 38' so as to break these fold lines.

The lowermost male die members 103 each comprise a base plate 112 having upstanding parallel fold plates 113, 114, 115 of identical shape which extend in longitudinally spaced transverse planes normal to the base plate 112, with the plates 114 and 115 at the leading and trailing ends of the plate 112 being equally spaced from the center plate 113. Each of the fold plates 113, 114 and 115 has a top section or portion 116 of rectangular shape with a top edge 117 and spaced parallel side edges 118, 118' which extend to outwardly slanted diverging edge portions 120, 120', the latter terminating short of the base plate 112 so as to leave parallel side edge portions 122, 122' adjacent the uppermost face of the base plate 112. The top edges 117 of the plates 113, 114 and 115 are dimensioned according to the length of the fold lines 27, 36 and 36' and are spaced longitudinally so as to engage a blank 10 on the center fold line 27 of the blank and inboard of the transverse fold lines 36, 36'. When the male and female die members 103 and 102 are properly indexed and brought into cooperating relation with a blank 10 properly positioned between them the blank is formed or shaped, as illustrated in FIG. 24, preparatory to assembling the blank with a group of bottles.

Figure 10:
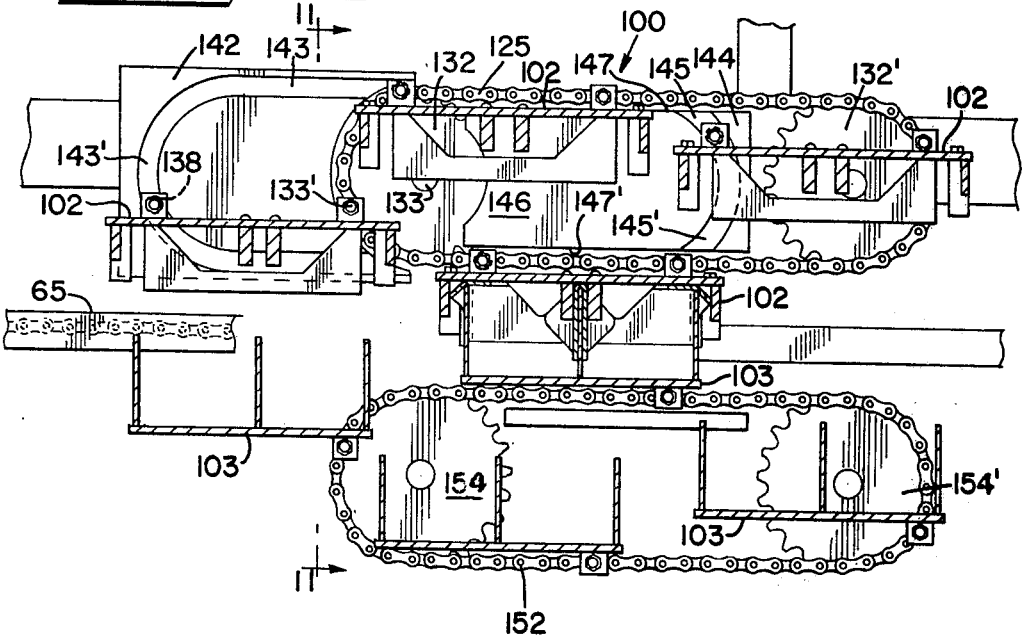
FIG. 10 is a longitudinal sectional view taken on the line 10—10 of FIG. 9.
Figure 9:
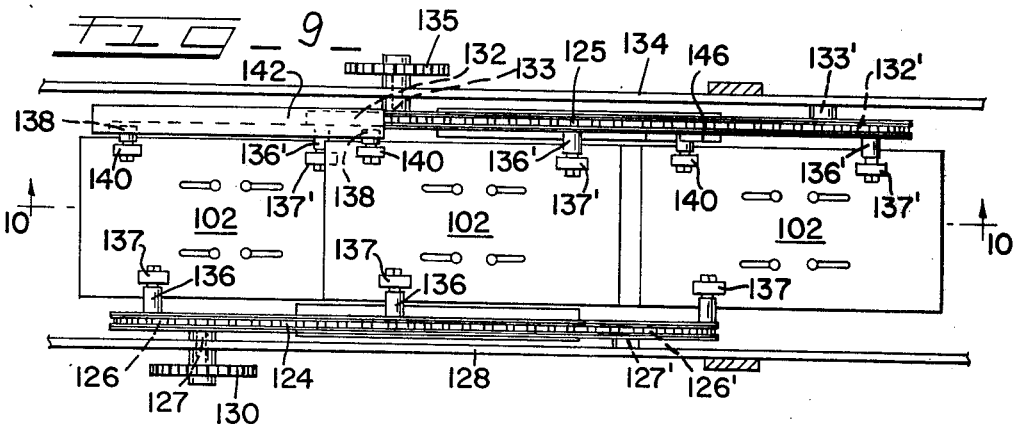
FIG. 9 is a partial plan view, taken on the line 9—9 of FIG. 1 to an enlarged scale, showing mechanism for pre-folding wall and handle forming panels on the blanks.

The uppermost female die or blank forming members 102 are carried on a traveling chain conveyor arrangement which comprises a pair of endless chain members 124 and 125 (FIGS. 9, 10 and 11) mounted for operation in laterally spaced planes and traveling in paths which are offset relative to each other in the direction longitudinally of the machine. The chain 124 is carried on end sprockets 126, 126' which are longitudinally spaced and mounted by means of short shaft members 127, 127' on a side frame member 128. The one shaft member carries a sprocket 130, for a continuous chain drive connection with a power shaft (not shown). The opposite chain 125 is carried on longitudinally spaced end sprockets 132, 132' which are mounted by means of small stub shafts 133, 133' on side frame plate 134. The one shaft 133 carries a sprocket 135 which provides for a sprocket and chain connection with a power drive shaft (not shown). The sprockets 132, 132' are offset relative to the corresponding sprockets 126, 126' in the direction longitudinally of the machine and are spaced laterally or transversely thereof so as to permit the forming die members 102 to be carried between the chains 124, 125. Each of the die forming members 102 is connected to the chains 124 and 125 at diagonally opposite corners by small pivot pin members 136, 136' which extend from bracket forming block members 137 and 137' secured on the uppermost face of the base plate 102. A cam follower roller 138 is supported at the corner opposite the bracket 137 by bracket forming block member 140 which is secured on the uppermost face of the plate 104. A vertically disposed cam plate 142 is mounted at the entrance end of the forming mechanism which has a cam track 143 for receiving cam follower 138. The cam track 143 has a configuration which includes a semi-circular portion 143' for holding the cam follower 138 in a path so that each die member 102 is held horizontal while the chains carry the die member around the sprocket 132 as illustrated in FIG. 10. At the other end of the die carrying chains 124, 125 there is a vertically disposed cam plate 144, with a cam track 145 having a semi-circular portion 145', which receives the cam follower 138 and holds the die member 102 in a level plane as it is carried to the top level or top run by the chain advancing upwardly around the end sprocket 132'. A vertical cam plate 146 is disposed in the plane of the end cam plates 142 and 144 which has track forming top and bottom edges 147, 147' on which the cam followers 138 ride so as to hold each of the die members 102 in a horizontal path as they are carried along the top and bottom runs of the chain 125.

The male die forming members 103 which are mounted for travel in the lowermost path so as to mate with the female die forming members 102, are carried on laterally spaced chains 150, 152. The chains 150, 152 are spaced in the same manner as the chains 124, 125 so as to carry the male die members 103 between them, the die members being connected to the chains at diagonally opposite corners of the base plates by pivot pins 153, 153'. The chains 150, 152 are carried on pairs of spaced end sprockets 154, 154' mounted on short stub shafts 155, 155' supported on spaced side frame plates 156, 157 and driven by sprocket and chain connection, indicated at 158, 158' in FIG. 11, with a drive shaft (not shown) forming part of the drive arrangement for the other driven members of the machine. The chains 150 and 152 are mounted in longitudinally offset relation and are in vertically aligned and vertically spaced relation with the chains 124, 125 which carry the upper forming die members 102 so that the lower runs of the upper chains 124, 125 travel in a horizontal path parallel with the path of the upper runs of the chains 150, 152 and are spaced vertically so as to enable the forming die members 102 and 103 to mate with a blank 10 between each mating pair of the die members as shown in FIG. 10.

At the leading or discharge end of the forming mechanism 100 the partially formed blanks are delivered to a transporting conveyor mechanism 160 at the work station D which conveyor 160 is operated to transport successive prefolded or pre-formed blanks to the work area or work station E where each successive blank is assembled with a group of bottles, that is, each blank is deposited on a group of bottles advancing on a bottle conveyor 162, the bottle carrying top run of which is traveling in a horizontal plane at a level below the blank conveyor 65. The bottles are initially advanced on the bottle feeding or supply conveyor 162 in a double row and in generally contacting relation to a bottle selector and group separating area below the blank transporting mechanism. The bottle conveyor 162 is supported on end sprockets, only one of which is shown at 163 (FIG. 1) at the leading end of the machine, and the conveyor is driven by suitable connection with the drive mechanism for other driven elements of the machine, the drive being synchronized with the drive for operating the conveyor 160 so as to position successive groups of bottles thereon for assembly with the partially folded blanks as the latter are advanced to the assembly station E by the conveyor 160. The bottles are segregated and grouped on the conveyor by mechanism hereinafter described.

Figure 12:
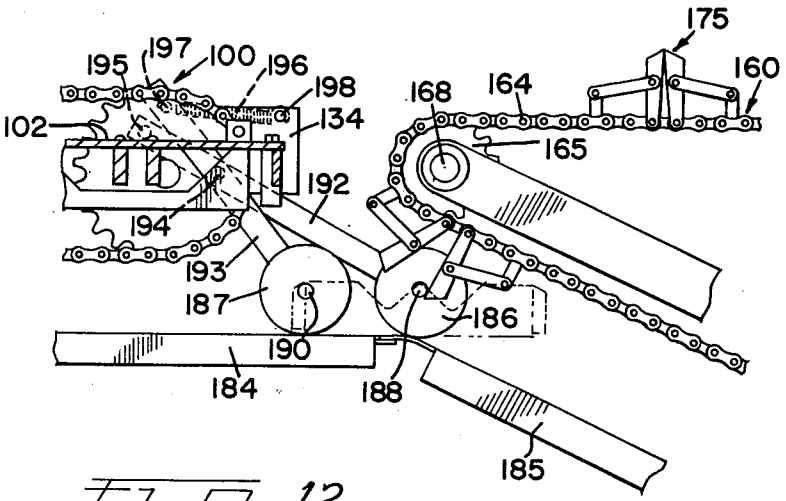
FIG. 12 is a fragmentary side elevational view, to an enlarged scale, showing the discharge end of the pre-folding mechanism and the entrance end of a carrier mechanism for advancing the pre-folded blanks, to a blank and bottle assembly station.
Figure 15:
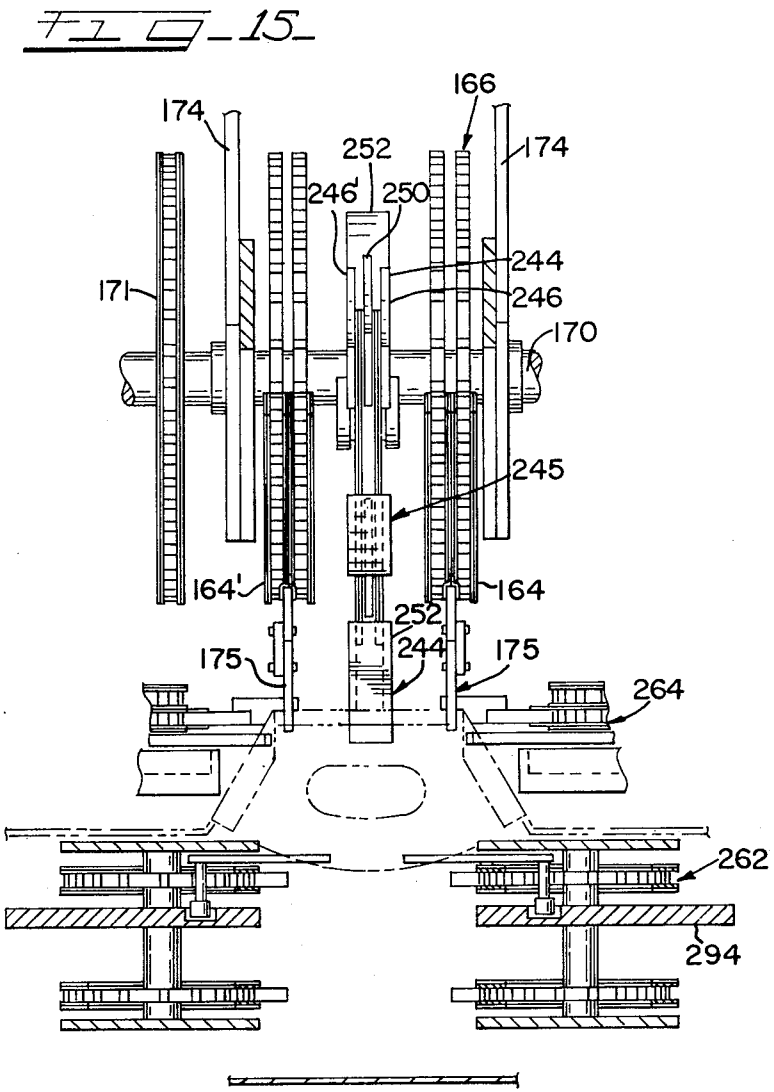
FIG. 15 is a cross sectional view taken on the line 15—15 of FIG. 13 to an enlarged scale.
Figure 11:
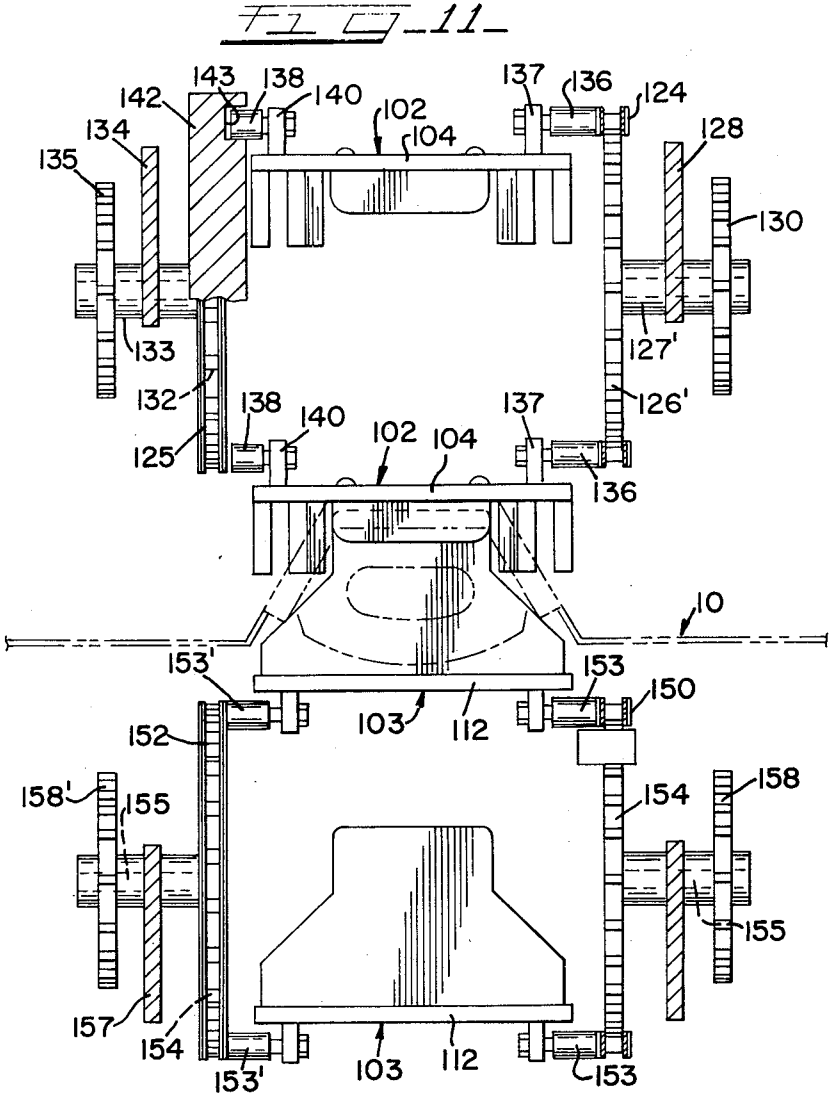
FIG. 11 is a cross sectional view taken on the line 11—11 of FIG. 10, to an enlarged scale.
Figures 13, 14:
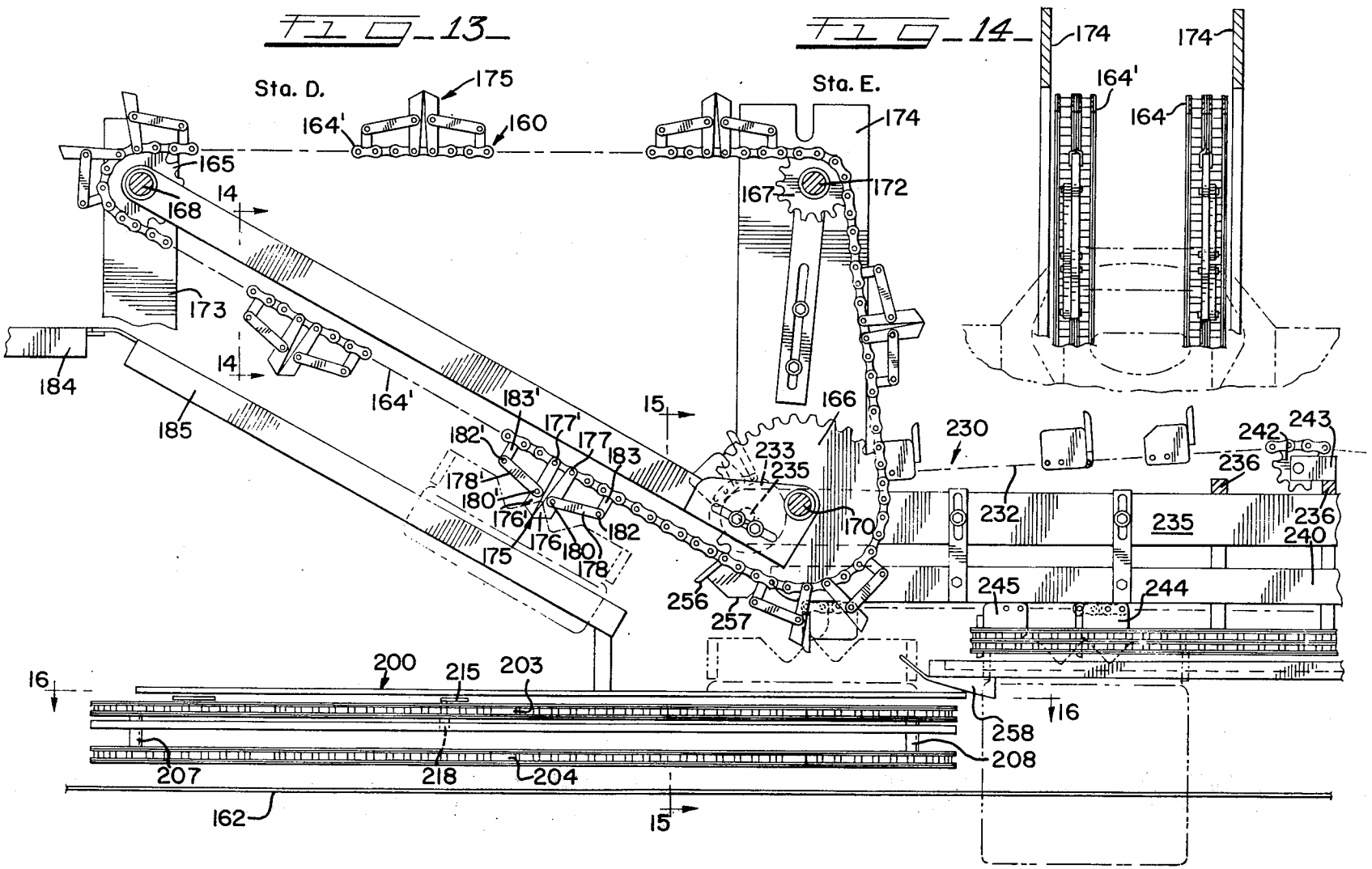
FIG. 13 is a partial side elevational view showing the carrier mechanism for advancing the pre-folded blanks to the blank and bottle assembly station, the view being taken on the line 13—13 of FIG. 2 to a larger scale.
FIG. 14 is a cross sectional view taken on the line 14—14 of FIG. 13.

The transfer conveyor 160 for advancing the partially formed blanks comprises a pair of laterally spaced chains 164, 164' (FIGS. 12, 13 and 14) which are carried on pairs of sprockets 165, 166, and 167 and arranged for travel in a triangular path, with a blank carrying run extending diagonally downwardly from the discharge end of the forming mechanism 100 to a point above the path of the bottle carrying run of the bottle conveyor 162 where the partially folded blanks are deposited on successive groups of bottles. The sprockets of each pair thereof are axially spaced on cross shaft 168, 170 and 172 which are supported on pairs of vertically disposed frame members 173 and 174 which are suitably spaced to accommodate the conveyor elements. The cross shaft 170 is extended at one end and a sprocket 171 (FIG. 15) is mounted thereon for a sprocket and chain driving connection with the drive mechanism for other driven elements of the machine. Each of the chains 164, 164' carries a series of clamp assemblies 175 which are arranged in transversely aligned paired relation so that the clamp members of each pair thereof cooperate in gripping a carton and holding it on the conveyor for transport to the assembly station E. The clamp assemblies 175 are constructed and operated in an identical manner for engagement and disengagement with the partially formed or partially folded blanks 10. Each clamp assembly 175 extends outboard of the associated support chain and comprises a pair of small clamp arms or plates 176, 176' which are pivotally mounted by means of successive link pivots 177, 177' on the associated chain, 164' as viewed in FIG. 13. Small link bars 178 and 178', are pivoted at one end, at 180, 180' to the clamp arms 176, 176' and at the other end, at 182, 182' to short post members 183, 183' which extend outboard in fixed relation from chain links which are spaced fore and aft of the clamp arms 176, 176'. With the mounting arrangement described and with the clamp arms 176, 176' in closed, clamping position, when the support chains are traveling in a straight path, the clamping arms 176, 176' are opened or swung apart when the chains traverse a curved path by passing around the sprockets 165, 166 and 167, the open position being shown in FIGS. 12 and 13, as a pair of clamp assemblies enter and leave the paths defined by sprockets 165 and 166, respectively. The sprockets 165 are positioned relative to the path of the partially folded blank 10 as it is discharged by the prefolding or pre-forming apparatus 100 so that a clamp assembly 175 is opened as it rounds the curved path defined by sprockets 165 and clamp arms 176, 176' move into position fore and aft relative to the pre-folded handle panels 34 and 35 and then close upon these panels as the assembly advances into the path defined by the downwardly inclined chain run where the clamp carrying chains are in a straight path. A support rail 184 (FIG. 12) extends along each side of the blank folding apparatus 100 at a level to support the blank side wall panels 17, 18 in the outwardly extending position shown in FIG. 24. Rails 185, for the same purpose, extend downwardly along the sides of the blank carrying inclined bottom run of the conveyor 160. The rails 185 form extensions of the rails 184 and a pair of hold down rollers 186, 187 are provided at each side of the path of the blank for cooperation with the rails 184, 185 to insure smooth passage of the pre-formed blanks from the horizontal to the inclined path traversed by the blank transporting run of the conveyor 160. The side wall panel hold down rollers 186, 187 are rotatably mounted at 188 and 190 on the ends of supporting bars 192 and 193. The two roller support bars are arranged in crossed relation and pivoted together at 194. The one bar 192 is extended from the pivot 194 and has its trailing end pivotally mounted at 195 on the horizontal frame member which supports the chains carrying the upper forming die members 102. The roller support bar 193 is extended beyond the pivot 194 and a tension spring 196 is connected at 197 to the free end of bar 193 and at the other end at 198 to a forward portion of the horizontal frame member. The two rollers 186 and 187 which ride on the rail 184 and the beginning of the rail 185 serve to hold each blank at the required level for the clamp assembly 175 to operate and close on the handle panels 34, 35. The rails 185 extend downwardly to a discharge point near the end of the path of the inclined run of the conveyor 160 (FIG. 13) where they terminate with sufficient clearance for downward movement of each successive blank onto a group of bottles advancing on the bottle conveyor 162, each blank being released by opening of the clamp jaw members 176, 176' as the clamp assembly 175 enters the circular path around the sprocket assembly 166.

The bottle feeding or bottle supply conveyor 162 has associated mechanism 200 (FIGS. 13 and 16) for segregating the bottles in the two lines which are advanced from the supply source and for forming them into groups of the desired number. In the machine illustrated, groups of eight bottles are formed, with the bottles in each group in double row and in transversely aligned pairs and with a gap of predetermined length between each group and the next succeeding group. The bottles enter the mechanism 200 on the conveyor 162 with the two lines separated by a vertical divider plate 202. The mechanism 200 comprises two pairs of lug carrying endless traveling conveyor chains 203, 203' and 204, 204' which are arranged for operation in parallel, vertically spaced, horizontally disposed planes. The chains of each pair thereof are laterally spaced so as to travel in a common plane and in paths along opposite sides of the path of the bottle supporting conveyor 162, with opposed inner runs confronting each other and in spaced relation. The uppermost chains 203, 203' are carried on longitudinally spaced end sprockets 205, 206 and 205', 206' (FIG. 16) which are secured on vertical shafts 207, 208 and 207', 208'. The sprocket shafts are disposed in spaced rectangular arrangement as shown. The lowermost chains 204, 204', which are vertically aligned beneath the corresponding upper chains 203, 203', are carried on end sprockets 210, 212 and 210', 212' which are secured on the vertical shafts 207, 208 and 207', 208' in vertically spaced relation to the corresponding sprockets for the uppermost chains. The lateral spacing of the shafts and the chain and sprocket dimensions are such that the confronting runs of the chains traverse parallel paths spaced apart a distance slightly greater than the combined transverse dimension of a pair of transversely aligned bottles as shown in FIG. 16. The upper chains each have a series of bottle engaging lugs 213 mounted in spaced relation thereon which extend outboard of the chains and which are spaced longitudinally, as shown in FIG. 16, a distance apart which is greater than the combined dimension of the bottles in the longitudinal direction. The lower chains 204, 204' have corresponding lugs 214 mounted thereon in the same manner and the chains are adjusted so that corresponding top and bottom pairs of the lugs 213, 214 are aligned to engage at vertically spaced, top and bottom points the trailing bottles in each group of the desired number and to advance the bottles as a group. In addition to the bottle selector lugs 213, 214, a series of group selector lugs or arms 215 are pivotally mounted intermediate their ends on the topmost pair of chains 203, 203' so as to provide arm portions 216 extending outboard of the chains and arm or heel portions 217 extending inboard thereof on which cam rollers 218 are mounted. The cam rollers 218 depend from the lugs 215 and are arranged to travel in cam tracks 220, 220' provided in horizontally disposed cam plates 222 and 222' which are arranged on opposite sides of the path of travel of the bottles and between the upper and lower pairs of chains 203, 203' and 204, 204'. The cam tracks 220, 220' are arranged so that the arms 216 of the lugs 215 which are properly spaced and transversely aligned on the chains are canted forwardly in the direction of bottle and chain travel as the bottles enter between the confronting chain runs. The arms 216 are then swung into engagement with the leading bottles in the group as they advance so as to bring the bottles into transverse alignment and into compact group arrangement for receiving the partially folded blanks as they reach the blank and bottle assembly station E.

The partially formed or pre-formed blanks are held in the downwardly diagonal path on the transporting conveyor 160 by the clamp assemblies 175 and the side rails 185 until a point is reached near the sprockets 166 where the clamp jaws of the assemblies 175 open and release the blanks. The side rails 185 terminate short of the sprockets 166 so that the successive blanks clear the bottom ends of the rails 185 and are free to drop onto groups of bottles as the latter are advanced on the conveyor 162 under the control of the group selector mechanism 200. A blank positioning and seating mechanism 230 (FIG. 13) is arranged to take over control of the successive blanks as they are freed by the clamp assemblies 175 and drop off the support rails 185 so as to properly position the blanks on the bottle assemblies for the subsequent operations which are required to complete the packages.

Figure 17:
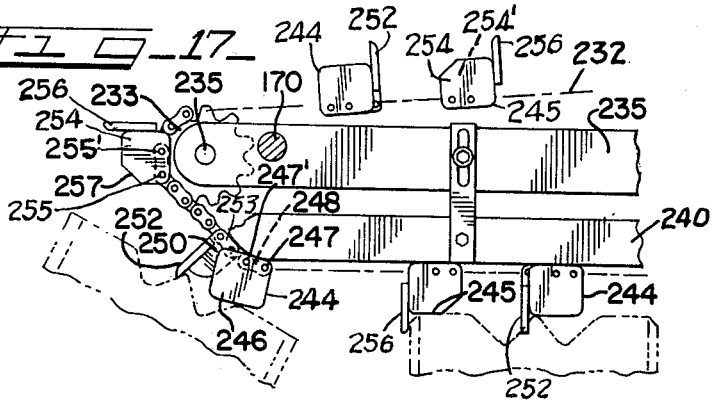
FIG. 17 is a sectional view, taken on the line 17—17 of FIG. 15 to a reduced scale, showing the operation of the blank engaging devices at the entrance to the blank seating mechanism.

The positioning and seating mechanism 230 (FIGS. 13, 15 and 17) comprises a traveling chain assembly 232 which is supported for travel in a longitudinally extending vertical plane. The chain 232 is supported on longitudinally spaced end sprockets 233 (FIG. 13) and 233' (FIG. 1). The one end sprocket 233 is carried on a cross shaft 234 adjacent the shaft 170 while the other end sprocket 233' is carried on a longitudinally spaced cross shaft 234'. The cross shafts 234, 234' are supported on a longitudinally extending frame member 235 which is suspended from cross frame members 236 so as to be located between the upper and lower runs of the chain 232. The chain 232 is centered between the sprockets 166 which carry the chains 164, 164' forming the transfer conveyor 160. The shaft 234' is extended at the one end and carries a driven sprocket 237 (FIG. 2) which is chain connected to a power drive shaft (not shown). A track forming longitudinally extending bar member 240 on which the lower run of chain 232 rides is adjustably suspended from the longitudinal frame member 235 which enables the lower chain run to be adjusted to a predetermined level above the level of the tops of the bottles advancing on the conveyor 162. The upper return run of the chain 232 is supported for travel above the cross frame member 236 by a tension sprocket 242 mounted on a support bracket 243 which is mounted for vertical adjustment on the longitudinal frame member 235. The chain 232 has mounted thereon, in alternate, longitudinally spaced relation, two sets of devices 244 and 245 for positioning and seating the blanks on the bottles. The blank positioning and seating devices 244 and 245 are spaced along the chain 232 in paired relation and the chain supporting sprocket 233 and guide bar 240 are positioned so as to engage a cooperating pair of the positioning devices 244 and 245 with each successive blank as each blank reaches the ends of the rails 185 and is released by opening of the clamp arms 176, 176' at the bottom of the diagonal run of the blank transporting conveyor 160. The blank positioning devices 244 and 245 are mounted in paired relation on the chain 232 and spaced apart according to the length of the top wall forming panel so that when the chain 232 is driven at the proper speed and properly indexed relative to the movement of the conveyor chains 164, 164' the leading device 244, of each pair thereof, will engage the blank in the center area, where the handle panels depend from the top wall panel, while the associated trailing device 245 will engage the blank at the trailing end of the top wall panel.

The blank positioning device 244 comprises a pair of generally rectangular plates 246, 246' (FIGS. 13, 15, 17, 18) which are positioned so as to straddle the chain 232 and extend outboard of the chain in parallel spaced planes. The plates 246, 246' have inner marginal portions secured adjacent the leading edges thereof on the outer ends of spaced link pins 247, 247' connecting opposite ends of a chain link 248 with the ends of the preceeding and trailing chain links. A single plate member 250 is positioned between the plates 246, 246' with a small relatively narrow cross plate 252 secured to its trailing edge and extending a short distance outboard of the outermost edge of the plate 250. The plate 250 is secured relative to a link 253 by mounting it on the center of the spaced pins which connect the opposite ends of the link 253 to the adjoining links. The links 248 and 253 are spaced apart by at least one link and when the device 244 traverses the curved path around the end sprocket 233 the pivoting of the links 248 and 253 swings the cross plate 252 away from the trailing edges of the plates 246, 246' and enables the plates 246, 246' and 252 to enter the handle openings fore and aft of the folded handle panels 34, 35 and engage the latter so as to serve initially to hold the handle panels in folded condition for insertion between the center pairs of bottles. As the blank is freed and moves down onto the bottles the device 244 moves down toward the end of the chain guide bar 240 on a diagonal path and the outermost edges of the plates 246, 246' ride up on the leading handle panel to a position where the edges engage the top panel at the center fold line and assist in seating the blank on the bottles. The device 244 closes as it advances onto the straight path defined by the guide bar 240 and the extended end of the cross plate 252 serves to center the blank and also acts as a pusher to assist in advancing the same. The cooperating trailing device 245 comprises a pair of generally rectangular plates 254, 254' which straddle the chain 232 in outboard extending relation and which have their inner margins secured on spaced chain link pivots 255, 255' with a relatively narrow cross plate 256 secured at their trailing edges so that when these devices travel in a curved path around the end sprocket the cross plate remains in fixed position relative to the plates 254, 254'. The latter have the leading corners cut away to provide a diagonal edge 257 and the cross plate 256 has its free end extended beyond the outermost edges of the plates 254, 254' so that upon initial contact with the blank the diagonal edge 257 will strike the trailing edge of the blank and slide along it until the extended end of the cross plate 256 engages the trailing edge. The blank is forced downwardly onto the tops of the bottles as the device 245 advances and the end of the cross plate 256 forces the small end wall panel at the trailing end of the top wall panel into position while the straight edge portions of the plates 254, 254' engage the trailing margin of the top wall panel and seat that portion of the blank on the bottles. As each blank is seated on the associated group of bottles the positioning and seating devices 244 and 245 remain in hold down position while the assembly is advanced on the conveyor 162 through a gusset tucking area or station F. Between the blank seating and gusset tucking area plows 258, 258' (FIGS. 13 and 18) mounted on opposite sides of conveyor 162 fold the side wall and bottom wall panels on the blanks downwardly into depending generally parallel position on opposite sides of the group of bottles where they remain while the blanks are held in seated position on the bottles and the gussets 42, 42' connecting the end wall panels 37, 37' and the side wall panels 25, 26 are tucked by mechanism 260 into final position prior to the folding and locking of the bottom wall forming panels.

The gusset tucking mechanism 260 comprises cooperating double chain assemblies 262, 262' arranged at opposite sides of the path of the blank and bottle assemblies and extending along the bottle supporting conveyor 162 in the area indicated as station F (FIGS. 1, 2 and 18, 19). Chain assemblies 262 and 262' and the associated elements are of identical construction and are disposed in mirror image relationship on opposite sides of the conveyor 162, with confronting runs extending in spaced relation along the path of conveyor 162. The one assembly 262 which extends along one side of conveyor 162 and its associated elements will be described in detail and corresponding parts of the assembly 262', which extends along the other side of conveyor 162, will be identified by the same numerals primed. The chain assembly 262 includes upper and lower endless chains 263, 264 which are carried in side by side relation on double sprockets 265, 266, 267 and 268 with an adjustably mounted tension sprocket 270 engaging the chains between the sprockets 266 and 267. The sprockets 265, 266, 267 and 268 are carried on the upper ends of vertical shafts 272, 273, 274, 275 and one of these shafts, preferably shaft 273, is connected to a power driven shaft for driving the assembly. The topmost chain 263 has a series of longitudinally spaced pairs of blank engaging lugs 276, 277 mounted in outboard extending relation thereon which are formed by small rectangular blocks or plates 278, 280, with each having a smaller block member 282, 283 on the free end. The chain 263 is at an elevation relative to the elevation of a blank and bottle assembly on the conveyor 162 and the lugs 276 and 277 of each pair thereof are spaced so that when they are advanced along the chain run adjacent the conveyor 162 they will engage on the top face of the top wall panel 16 adjacent the leading and trailing ends of the wall panel and restrain the corners of the panel against upward movement. The chain 264, which travels beneath the chain 263, has mounted thereon a plurality of pairs of arms or fingers 284, 285 for tucking the gussets 42 at the leading and trailing ends of the blank. The tucking fingers 284, 285 of each pair are pivotally mounted intermediate their ends on chain link pivots 286 and 287 which are spaced lengthwise of the chain 264, and portions of the fingers extend on opposite sides of the chain. On the outboard side the fingers carry on their free ends small tucking plates 288 and 290 which are carried at an elevation enabling them, when traveling in operative or working position along the chain run adjacent the side of the conveyor 162, to be engaged with the gussets 42 so as to tuck the latter into final position. On the inboard side of the chain 264 the fingers 284, 285 carry on their free ends cam follower rollers 292, 293. A cam plate 294 is mounted immediately below the chain 264 and extends in a horizontal plane with a portion 295 beneath the chain run which is immediately adjacent the path of conveyor 162 and another portion 296 extending outboard of the same at the entrance end of the parallel confronting chain runs of the two assemblies 262 and 262'. An upwardly opening cam track 297 receives the cam followers 292 and 293 so as to control the swinging movement of the tucking fingers 284, 285. The cam track has a configuration, or pattern, which causes each pair of cooperating tucking fingers 284 and 285, as they approach the conveyor 162 at the entrance between the confronting runs of the chain assemblies 262 and 262', to swing apart to a position on the chain 264 where they are fore and aft of a blank and bottle assembly which is advancing on the conveyor 162. As they advance along the conveyor 162 the fingers 284 and 285 are swung toward the leading and trailing ends of the blank and bottle assembly so as to bring the tucking plates 288 and 290 into engagement with the gussets 42. At the ends of the confronting chain runs the tucking fingers 284 and 285 are cammed apart to clear the assembly for advance on the conveyor 162 to mechanism for completing the application of the blank to the bottle assembly. The conveyor 162 advances the successive assemblies to a mechanism for folding the panels 20, 22 into bottom wall forming position and for engaging the locking and latching elements 50, 52.

The conveyor 162 has been indicated schematically on the drawings. It will be a type conveyor suitable for operating with known mechanism for closing the bottom wall panels and locking and latching the same, such as, for example, the mechanism disclosed in my U.S. Pat. No. 3,474,590, granted Oct. 23, 1969, or re-issue U.S. Pat. No. Re. 26,750, dated Jan. 6, 1970.

The operation of the machine will be apparent from the foregoing description. It will be understood that suitable power drive arrangements are provided for operating in proper timed relation the traveling elements of the machine so as to obtain smooth continuous operation and that more detailed description of such mechanism has been omitted as unnecessary for an understanding of the present invention and in the interest of bevity. Likewise, suitable framing members are provided to support the various mechanisms in proper relation to each other for the desired operation and a detailed description thereof does not appear to be necessary to understand the invention.

I claim:

1. A machine for packaging a group of articles having the general shape of beverage bottles in wraparound type blanks of foldable sheet material which is cut and scored to provide hingedly connected top wall, sidewall and bottom wall forming panels, the bottom wall forming panels having associated wall reinforcing panels at opposite ends of the blank which are initially held in the plane of the blanks by uncut portions of the blanks, said wall reinforcing panels being adapted, when released, to hinge on a score line spaced inwardly of the end edges of the blank so as to be folded into flat engagement with adjoining portions of the blank and to be secured by engaging end marginal portions beneath bendable tab members cut in the sidewall panels, said machine comprising a blank carrying conveyor having a generally horizontal run with means thereon for supporting successive blanks which are positioned thereon with said reinforcing panels disposed so as to travel along opposite sides of the blank supporting conveyor, and means disposed along opposite sides of said conveyor run engaging the blanks at points on opposite faces thereof for breaking said uncut portions of successive blanks so as to release the end panels, means disposed along said conveyor run for hinging said reinforcing panels into engagement with adjoining face portions of the blanks and means disposed along said conveyor run for engaging said tab members and said reinforcing panels so as to force said tab members into overlying relation with marginal portions of said reinforcing panels thereby to secure said reinforcing panels in engagement with said adjoining portions of the blanks.

2. A machine as set forth in claim 1 wherein said means for breaking said uncut portions of said blanks comprises a pair of cooperating rotatably mounted roller members disposed along opposite sides of said blank carrying conveyor so that end portions of the blanks are advanced between the same, one of said rollers engaging said reinforcing panels and holding the same in the plane of adjacent portions of the blank and the other one of said rollers having radially extending circumferentially spaced finger members thereon for engaging inwardly spaced portions of said blank while said reinforcing panels are held against movement and for forcing said engaged portions out of the plane of said reinforcing panels so as to break the uncut portions.

3. A machine as set forth in claim 1 wherein said means for hinging said reinforcing panels comprises plow means shaped to engage said reinforcing panels and hinge them into engagement with adjacent portions of the blanks and said means for engaging said tab members comprises a roller member having circumferentially spaced punch forming members thereon which are positioned to engage said tab members and bend the same into a position where they are in locking relation with marginal portions of said reinforcing panels.

4. A machine as set forth in claim 1 wherein said means for breaking said uncut portions of said blanks comprises roller members having means thereon for engaging the reinforcing panels and adjoining blank portions so as to break the uncut blank portions, and said means for engaging said tab members comprises a roller member having a peripherial surface which as a relatively small axial dimension and pairs of radially extending finger members disposed in spaced relation on opposite end faces thereof with one of each pair thereof located so as to engage portions of the blank and the tab members and move said tab members into position for securing said reinforcing panels in engagement with said adjoining portions of said blanks.

5. A machine as set forth in claim 1 wherein said means for engaging said tab members and said reinforcing panels comprises a roller member having mounted thereon radially projecting pairs of axially spaced finger members arranged in circumferentially spaced relation and traveling in a path relative to the path of the conveyor so that one finger member of a pair thereof engages an edge of the material defining an aperture in the blank while the associated finger member engages a tab member and forces it into position for engagement with a marginal portion of the folded reinforcing panel.

* * * * *